United States Patent [19]

Yu

[11] Patent Number: 4,853,992

[45] Date of Patent: Aug. 8, 1989

[54] AIR COOLED/HEATED SEAT CUSHION

[76] Inventor: Kaung H. Yu, 13618 Braeswest Dr., Houston, Tex. 77082

[21] Appl. No.: 222,932

[22] Filed: Jul. 22, 1988

[51] Int. Cl.[4] ..... A47C 21/04

[52] U.S. Cl. ..... 5/423; 5/469

[58] Field of Search ..... 5/421, 423, 461, 453, 5/468, 469; 297/180, 453

[56] References Cited

U.S. PATENT DOCUMENTS

| | | | |
|---|---|---|---|
| 2,158,801 | 5/1939 | Petterson | 297/180 X |
| 2,461,432 | 2/1949 | Mitchell | 5/469 X |
| 2,493,067 | 1/1950 | Goldsmith | 5/423 |
| 2,795,803 | 6/1957 | Radzik | 5/468 |
| 2,922,466 | 1/1960 | Marston | 5/461 |
| 2,992,604 | 7/1961 | Trotman et al. | 297/180 X |
| 3,529,310 | 9/1970 | Olmo | 5/423 |
| 4,002,108 | 1/1979 | Drori | 5/468 X |
| 4,006,604 | 2/1977 | Seff | 5/469 X |
| 4,563,387 | 1/1986 | Takagi et al. | 5/461 X |

*Primary Examiner*—Michael F. Trettel

[57] ABSTRACT

An air cooled/heated seat cushion comprises: an envelope with an air inlet opening and an air discharge opening. A flexible hollow supporting padding is embedded inside the envelope to allow air to diffuse through the envelope. As air from a ventilation air source of a car, truck, or craft flows through the cushion, the cushion is cooled or heated. The cusion in turn gives a cooling or heating sensation to a person sitting on it. An even better way is to employ an air distributor inside the envelope, so that air can be uniformly distributed throughout the cushion.

8 Claims, 3 Drawing Sheets

AIR COOLED/HEATED SEAT CUSHION

BACKGROUND OF THE INVENTION

This invention relates to seat cushions, and more particularly to an air cooled/heated cushion that provides a cooling or heating sensation for a person sitting on it. Conventional screen seat cushions having ample void spaces inside, have very little success in providing a cooling or heating sensation to a person, due to the fact that inside the cushions the air is almost stagnant without motive force applied. Other types of cushions such as soft seat cushions, the internal soft fillings having intricate or isolated pores, make it almost impossible for air to flow through. One might attempt to attach an air tube to a screen seat cushion to achieve cooling or heating effect by blowing air through it, the result will be to no avail, because most of the air will penetrate out of the envelope near the air inlet opening instead of flowing through the inside of the envelope. This invention applies the basic principle of heat transfer. An air tube is connected between the cushion and an air source. The motive air from the air source firstly cools or heats the cushion, in turn the cushion cools or heats the person sitting on it. In this way, the cooling or heating is gradual and indirect, and not as acute as direct air blowing, thus providing long lasting comfort to the person.

SUMMARY OF THE INVENTION

According to the present invention, an air cooled/-heated seat cushion comprises an envelope consisting of top and bottom wall members. The two wall members are connected to each other around the edges. An air inlet opening is located at one edge of the envelope for permitting air to enter the cushion. An air discharge opening is located at the other edge for air to exit. Inside the cushion, a flexible hollow supporting padding is provided, thus allowing air to diffuse through the cushion. An air tube is used to connect the cushion to an air source for providing the motive air. As the air flows through the cushion, the cushion will provide a cooling or heating sensation to a person sitting on it.

An even better way to achieve uniform air distribution inside the envelope is to apply an air distributor. The air distributor is located inside the cushion at one edge and has a plurality of air distributing holes directed toward the interior of the cushion.

According to another aspect of this invention, the seat cushion is elongated and folded in the middle to provide an additional back pad section.

The primary object of the present invention is to provide a cushion which is comfortable and capable of providing an effective cooling or heating sensation to a person sitting on it. Another object is to provide a cushion which is simple in construction and suitable for mass production at a low cost. Further objects and advantages of my invention will become apparent from a consideration of the drawings and ensuing descriptions thereof.

BRIEF DESCRIPTION OF THE DRAWINGS

The present invention will now be explained with reference to the accompanying drawings, in which.

DETAILED DESCRIPTION OF THE INVENTION

Figure 1:
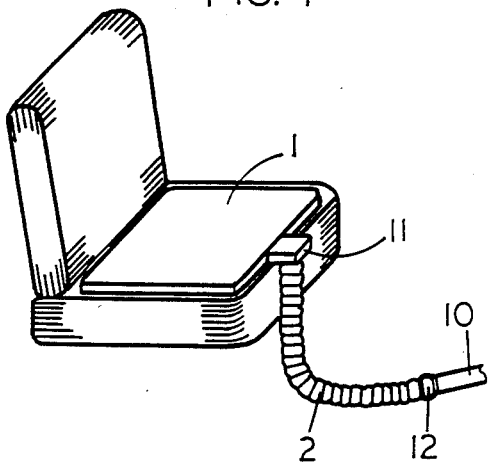
FIG. 1 is a perspective view of the air cooled/heated seat cushion shown in its position on top of a seat.

Referring to FIG. 1, there is shown an embodiment of this invention. As shown, the cushion is placed on top of a seat. The cushion includes an envelope 1 and an air tube 2. One end of the air tube 2 is connected to the envelope 1 by any suitable cushion coupler 11. The other end of the tube 2 is connected to an air source 10 by any suitable air source coupler 12. Envelope 1 has top and bottom wall members. The two wall members are connected to each other around the edges. It is to be understood that any suitable means such as heat welding, stitching, glueing, or the like may be used for connecting the two wall members of the envelope 1.

Figure 2:
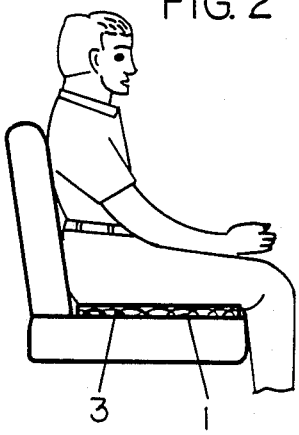
FIG. 2 is a cross-sectional view of the air cooled/-heated seat cushion shown in FIG. 1, with a person sitting on it.
Figure 3:
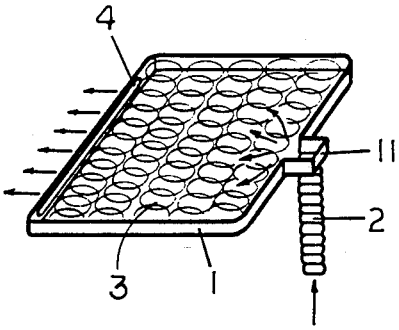
FIG. 3 is an interior view of the air cooled/heated seat cushion shown in FIG. 1.

Referring to FIGS. 2 and 3, envelope 1 may be made of flexible vinyl, plastic, leather, fabric with vinyl backing, tightly knitted fabric, or other material with low air penetrability. A flexible hollow supporting padding 3 which acts as a supporting media between top and bottom members of the envelope 1, also provides void space for motive air to flow through. The padding 3 may be in the shape of coils, wires, corrugations, protrusions, channels, or other suitable configurations. The material of padding 3 may be metal, plastic, rubber, or other suitable compositions. As shown in FIG. 3, an air discharge opening 4 is located approximately opposite to the cushion coupler 11, which may be holes, slotted openings, or a zipper opening. A zipper opening provides means for varying the flow of motive air through the cushion.

Figure 4:
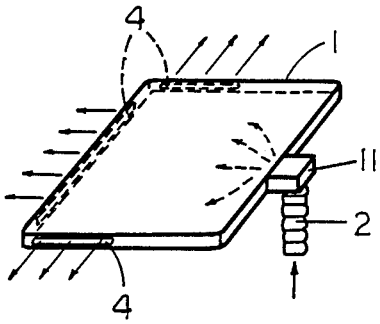
FIGS. 4 and 5 are perspective views of modification of the air cooled/heated seat cushion, shown with multiple air discharge openings.
Figure 5:
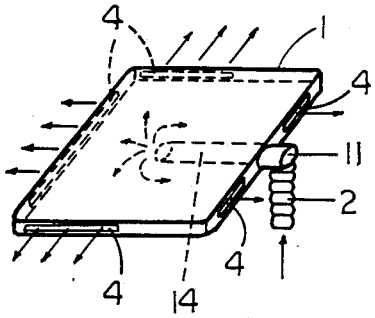

FIGS. 4 and 5 show another embodiment of the present invention with multiple air discharge openings 4. In this way, air can discharge through more than one edge of the envelope 1. For clarity reasons, the padding 3 is not shown. As shown more particularly in FIG. 5, a flexible self-supporting air duct 14 is connected to cushion coupler 11, are terminated in the middle of envelope 1, so that air can diffuse from the center to the edges of the envelope 1.

Figure 6:
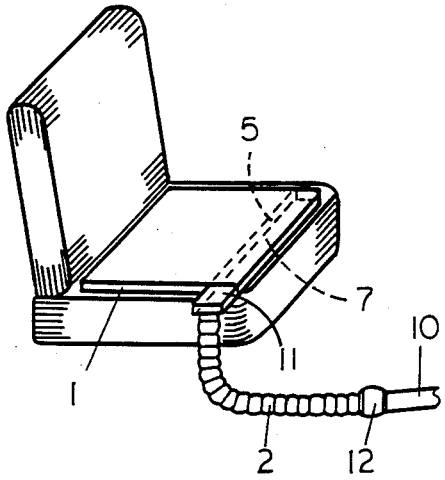
FIG. 6 is a perspective view of another modification of the air cooled/heated seat cushion, shown with an air distributing channel.
Figure 7:
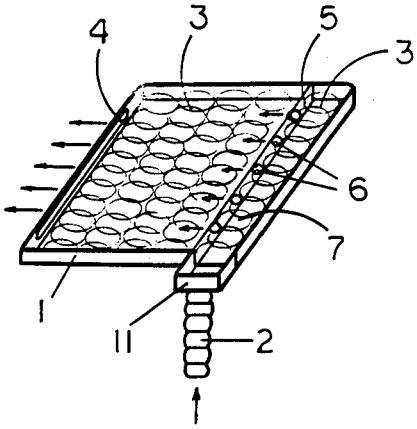
FIG. 7 is an interior view of the air cooled/heated seat cushion shown in FIG. 6.

Referring to FIGS. 6 and 7, there is shown a modified embodiment of my invention. A partitioning wall 5 joins with the envelope 1 to form an air distributing channel 7. As shown in FIG. 7, inside the channel 7, the space is filled with the same padding 3 as supporting media. A plurality of small air holes 6 are uniformly spaced through the partitioning wall 5 for uniformly distributing air throughout the envelope 1. Referring to FIG. 6, the envelope 1 may be permanently attached to a seat, and formed as a part of the seat.

Figure 8:
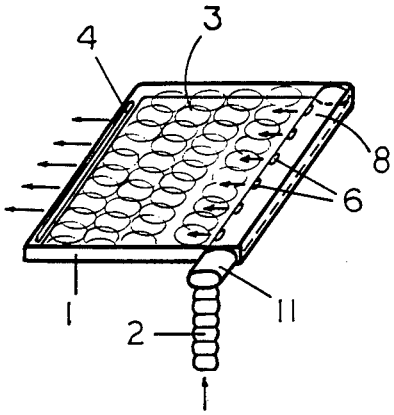
FIG. 8 is an interior view of another modification of the air cooled/heated seat cushion, shown with an air distributing tube.

Another embodiment of my invention is shown in FIG. 8. A flexible self-supporting air distributing tube 8 is inserted into envelope 1. One end of the distributing tube 8 is sealed and the other end is connected to cushion coupler 11. A plurality of small air holes 6 are uniformly spaced through the distributing tube 8 for uniformly distributing air throughout the envelope 1.

Figure 9:
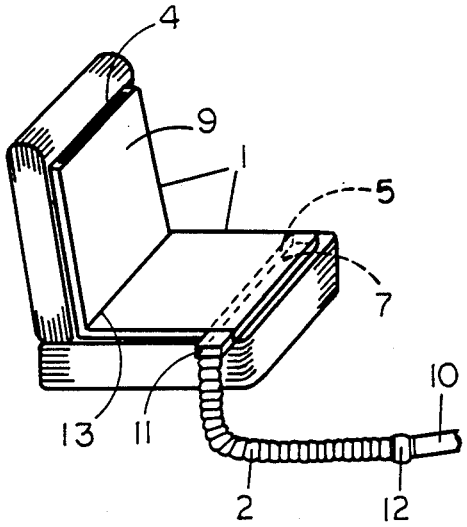
FIG. 9 is a perspective view of a preferred embodiment of the air cooled/heated seat cushion, shown with a back pad section.
Figure 10:
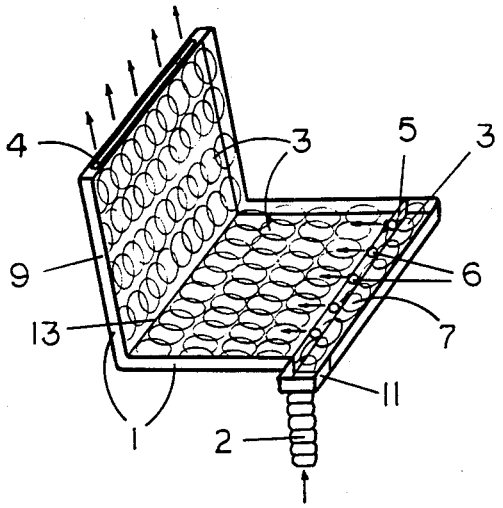
FIG. 10 is an interior view of FIG. 9.

FIGS. 9 and 10 show a preferred embodiment of the present invention in which the cushion is made of elongated shape. A folding zone 13 is positioned approximately in the middle of the cushion thus providing an additional back pad section 9.

CONCLUSION, RAMIFICATION AND SCOPE OF INVENTION

While the above description contains many specifities, these should not be construed as limitations on the scope of my invention, rather as exemplifications of preferred embodiments thereof. Many other variations are possible. For example, the material of the padding can be varied so long as they are flexible, resilient, self-supporting, comfortable, and have ample void spaces for air to diffuse through. Accordingly, the scope of the invention should be determined not by the embodiments illustrated, but by the appended claims and their legal equivalents:

What I claim is:

1. An air cooled/heated seat cushion for providing a cooling/heating sensation to a person, comprising:

a flexible envelope with an air distributing channel located inside one edge of said envelope, said channel includes a flexible partitioning wall connected to said envelope, said partitioning wall having a plurality of holes, padding means embedded inside said envelope and said channel, said padding being flexible and having void spaces for diffusing air within said channel and said envelope, means defining an air inlet opening formed at one end of said channel for permitting air to enter said channel and diffuse through said envelope, means defining an air discharge opening formed at the other edges of said envelope for discharging air out of said envelope, said air discharge opening being approximately opposite to said air inlet opening, an air tube, having one end connected to said air inlet opening, and a coupling means for connecting the other end of said air tube to an air source for providing motive air to said envelope, whereby the person sitting on said cushion can have a cooling/heating sensation when cooled/heated air flows through said cushion.

2. The invention of claim 1 wherein said air discharge opening is a zipper opening, whereby the air flow rate through said envelope can be controlled by adjusting said zipper opening.

3. The invention of claim 1 wherein said air discharge opening has a plurality of holes.

4. The invention of claim 1 wherein said air discharge opening is located on top of said envelope approximately opposite to said air inlet opening.

5. The invention of claim 1 wherein said envelope including a plurality of air seeping holes, the number of said seeping holes is limited so that only small amount of air may seep through.

6. The invention of claim 1 wherein said envelope is made of a material characterized by vinyl, plastic, leather, fabric with vinyl backing, tightly knitted fabric having very low air penetrability, and a combination of these, whereby the majority of the air flows through said envelope instead of penetrating out of said envelope.

7. The invention of claim 1 wherein said padding is made of a material characterized by metal, plastic, rubber, and a combination of these, and having a shape characterized by coils, wires, corrugations, protrusions, and channels, whereby the air can diffuse through said padding and contact with said envelope.

8. The invention of claim 1 wherein said envelope is permanently attached to a seat, and formed as an integral piece.

* * * * *

UNITED STATES PATENT AND TRADEMARK OFFICE

CERTIFICATE OF CORRECTION

PATENT NO. : 4,853,992

DATED : August 8, 1989

INVENTOR(S) : Kaung H. Yu

It is certified that error appears in the above-identified patent and that said Letters Patent is hereby corrected as shown below:

Title page:

Inventor:

Change "Kaung H. Yu" to --Kaung M. Yu--

Signed and Sealed this

Second Day of October, 1990

*Attest:*

HARRY F. MANBECK, JR.

*Attesting Officer*

*Commissioner of Patents and Trademarks*